US007748340B1

(12) United States Patent
Hilton

(10) Patent No.: US 7,748,340 B1
(45) Date of Patent: Jul. 6, 2010

(54) OFFICIATING FLAG APPARATUS

(76) Inventor: Brett P. Hilton, 2102 Lions Paw, Augusta, GA (US) 30309

( * ) Notice: Subject to any disclaimer, the term of this patent is extended or adjusted under 35 U.S.C. 154(b) by 40 days.

(21) Appl. No.: 12/238,008

(22) Filed: Sep. 25, 2008

(51) Int. Cl.
*G09F 17/00* (2006.01)
*B65B 1/30* (2006.01)

(52) U.S. Cl. ..... 116/2; 116/281; 116/173; 116/DIG. 1; 141/94; 417/234

(58) Field of Classification Search ..... 116/1, 116/2, 173, 174, DIG. 1, DIG. 7, 266, 271, 116/276; 40/586, 598; 473/610, 611; 417/234, 417/554; 137/227; 446/220, 224; D8/31; D11/166, 181, 182; D21/781, 722
See application file for complete search history.

(56) References Cited

U.S. PATENT DOCUMENTS 1,153,206 A * 9/1915 Eisenberg ..... 446/180
1,649,530 A * 11/1927 Holsinger ..... 137/227
3,217,690 A * 11/1965 Mihalisin ..... 116/173
4,673,007 A 6/1987 Huang
4,712,592 A 12/1987 Brown
5,016,894 A 5/1991 Alioto
5,324,174 A 6/1994 Diotte
5,433,136 A * 7/1995 Lung-Po ..... 92/58.1
5,556,258 A * 9/1996 Lange et al. ..... 417/63
5,557,253 A 9/1996 Hegemann et al.
D375,274 S 11/1996 Malone, II et al.
6,067,013 A * 5/2000 Pejic ..... 340/539.1
6,155,197 A * 12/2000 Stanley ..... 116/173
6,923,222 B2 * 8/2005 Gaines ..... 141/98

* cited by examiner

*Primary Examiner*—Amy Cohen Johnson
(74) *Attorney, Agent, or Firm*—Crossley Patent Law; Mark A. Crossley

(57) ABSTRACT

The officiating flag apparatus is partly an air pump having a pump with removably attachable air fitting. An air gauge is disposed on and in communication with the pump. An officiating flag is attached to the pump, thereby combining a pump, an air pressure gauge, and an officiating flag in one apparatus.

2 Claims, 3 Drawing Sheets

OFFICIATING FLAG APPARATUS

BACKGROUND OF THE INVENTION

In sports officiating, in such sports as soccer for example, officials often use flags to signal various infractions and notifications to fans, players, and coaches. Additionally, in sports involving inflatable implements such as balls, of which many exist, implements often need to be gauged and correctly deflated or inflated to correct pressures. This is important to the play of the games, and is typically ruled so. However, officials are often without a gauge and a pump with which to perform these functions. Looking for, finding, and using a pump and gauge, if even present, requires delay of a game. The present apparatus combines a pump with air pressure gauge and a flag, thereby solving the above problems.

FIELD OF THE INVENTION

The officiating flag apparatus relates to sports officiating flags and more especially to a sports officiating flag apparatus which combines a pump, air pressure gauge, and flag.

SUMMARY OF THE INVENTION

The general purpose of the officiating flag apparatus, described subsequently in greater detail, is to provide a officiating flag apparatus which has many novel features that result in an improved officiating flag apparatus which is not anticipated, rendered obvious, suggested, or even implied by prior art, either alone or in combination thereof.

To attain this, the officiating flag apparatus combines an officiating flag, which is optionally provided in embodiments to comply with a variety of sports, with an air pump and an air pressure gauge. The gauge reads air pressure within the pump chamber, when the chamber is in communication with a given sports pneumatic implement via a removable air fitting. Implements range from soccer balls to almost any inflatable game implement. The apparatus provides an effective handle for an official to grasp, whether in using the flag or in using the pump. One optional embodiment provides a compartment in the handle for storage of air fittings or other items which might be convenient in a given sport. Still another embodiment provides a screw off pump handle cap removably affixed to a hollow pump handle, providing further storage means. An added embodiment provides an externally fitted clip on the handle for removably holding an air fitting such as a ball needle, for example. Air fittings are removably fitted to the pump first end so that any type of air fitting will not pose threat of injury or inconvenience when not needed.

Thus has been broadly outlined the more important features of the improved officiating flag apparatus so that the detailed description thereof that follows may be better understood and in order that the present contribution to the art may be better appreciated.

An object of the officiating flag apparatus is to provide more than one function in a sports officiating flag apparatus.

Another object of the officiating flag apparatus is to provide a sports officiating flag with an easy to hold handle.

A further object of the officiating flag apparatus is to combine a pump with the flag.

An added object of the officiating flag apparatus is to combine an air pressure gauge with the pump.

And, an object of the officiating flag apparatus is to provide more than one storage means for a variety of air fittings or other needs.

These together with additional objects, features and advantages of the improved officiating flag apparatus will be readily apparent to those of ordinary skill in the art upon reading the following detailed description of presently preferred, but nonetheless illustrative, embodiments of the improved officiating flag apparatus when taken in conjunction with the accompanying drawings.

In this respect, before explaining the current embodiments of the improved officiating flag apparatus in detail, it is to be understood that the officiating flag apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved officiating flag apparatus. It is therefore important that the claims be regarded as including such equivalent constructions insofar as they do not depart from the spirit and scope of the officiating flag apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 6 thereof, the principles and concepts of the officiating flag apparatus generally designated by the reference number 10 will be described.

Figure 6:
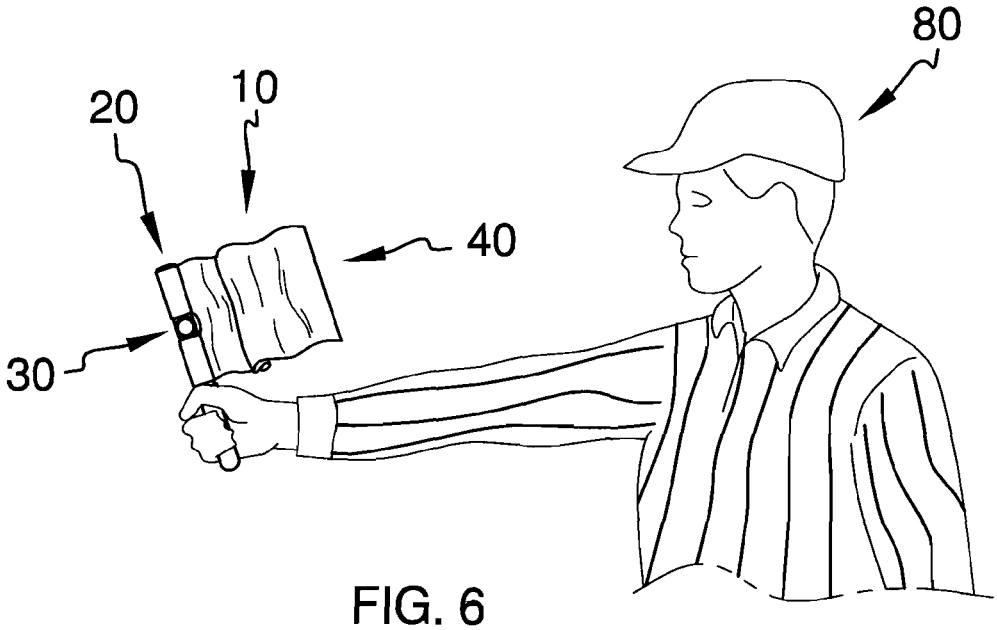
FIG. 6 is a lateral elevation view of the apparatus in use by an official.

Referring to FIG. 6, the officiating flag apparatus 10 provides an air pump 20 with an air pressure gauge 30 and an officiating flag 40. The apparatus 10 thereby enables an official 80 to make officiating calls in a given sport, and to gauge and if necessary deflate and inflate a given pneumatic implement of a sport.

Figure 1:
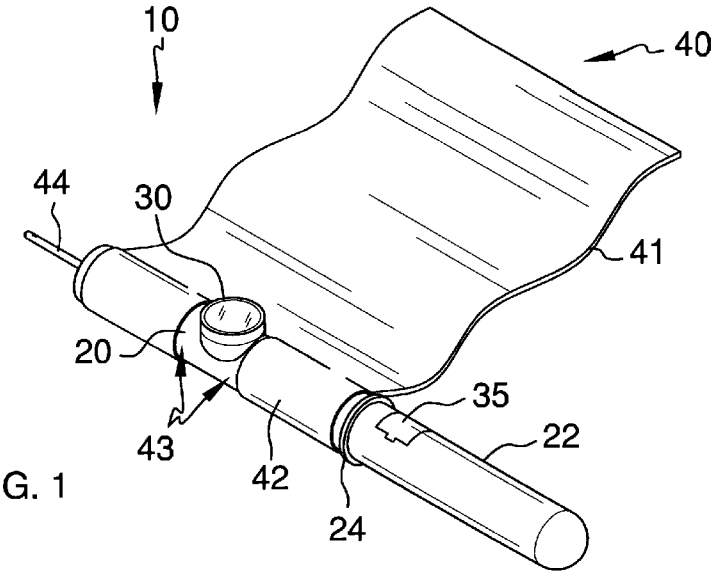
FIG. 1 is a perspective view, pump handle depressed.
Figure 2:
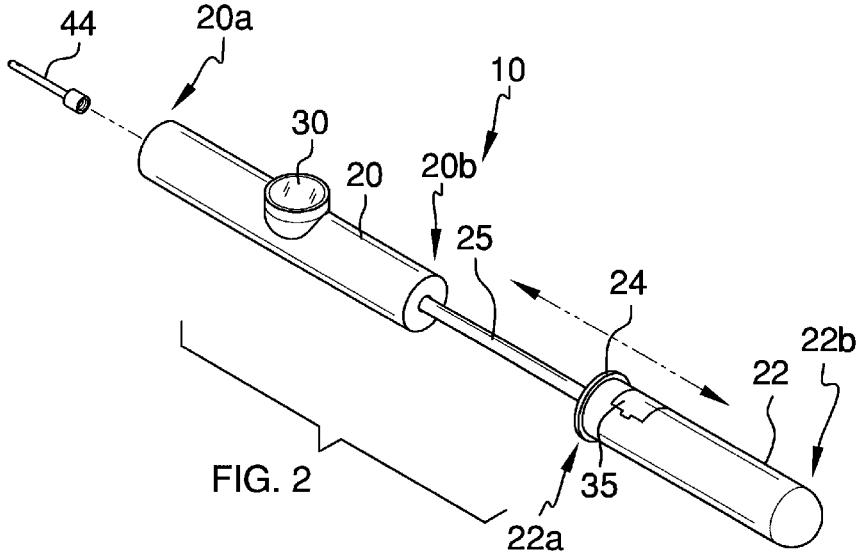
FIG. 2 is a perspective view, pump handle extended and air fitting removed.

Referring to FIGS. 1 and 2 the cylindrical air pump 20 has a pump first end 20*a* and a pump second end 20*b*. The air fitting 44 is selectively disposed within the pump first end 20*a*. The pump first end 20*a* is optionally provided in various embodiments (not shown) which are familiar in the art and which provide more than one means for various air fitting 44 attachments. The cylindrical chamber 21 is disposed within the pump 20. The air pressure gauge 30 is affixed exteriorly to the pump 20. The gauge 30 is in communication with the chamber 21. The sealed shaft 25 is slideably disposed within the chamber orifice 23 of the pump 20. The shaft 25 has a shaft first end 25*a* and a shaft second end 25*b*.

Figure 5:
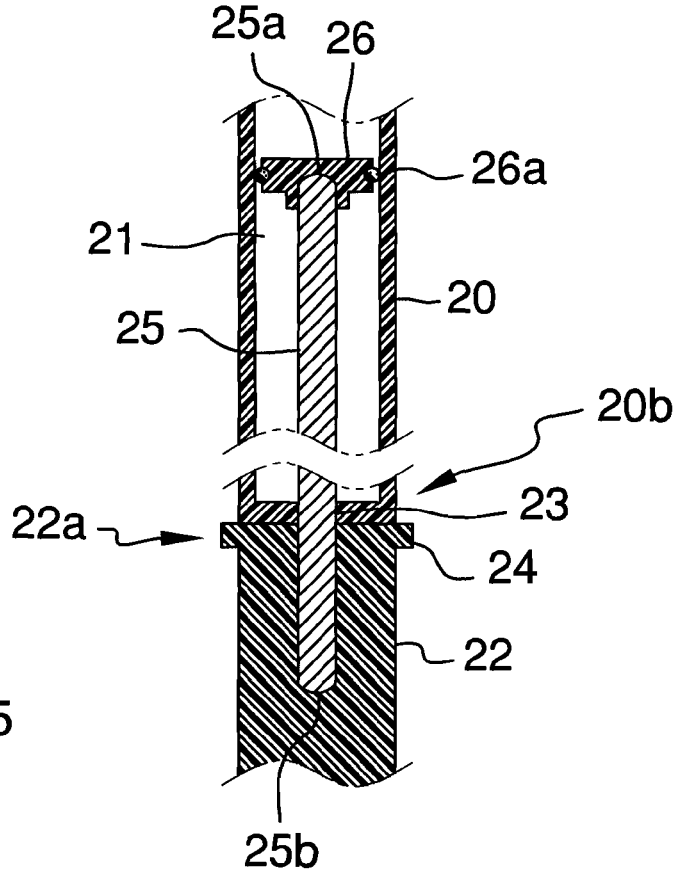
FIG. 5 is a cross sectional view of FIG. 4, taken along the line 5-5.

Referring to FIG. 5, the shaft first end 25*a* is disposed within the chamber 21. The plunger 26 is disposed on the shaft first end 25*a*. The seal 26*a* slideably seals the plunger 26 to the chamber 21. The cylindrical handle 22 has a handle first end 22*a* and a handle second end 22*b*. The handle first end 22*a* is affixed to the shaft second end 25*b*. The stop 24 is disposed on the handle first end 22*a*. The stop 24 slidingly abuts the pump second end 20*b* with the plunger 26 fully depressed within the chamber 21.

Figure 3:
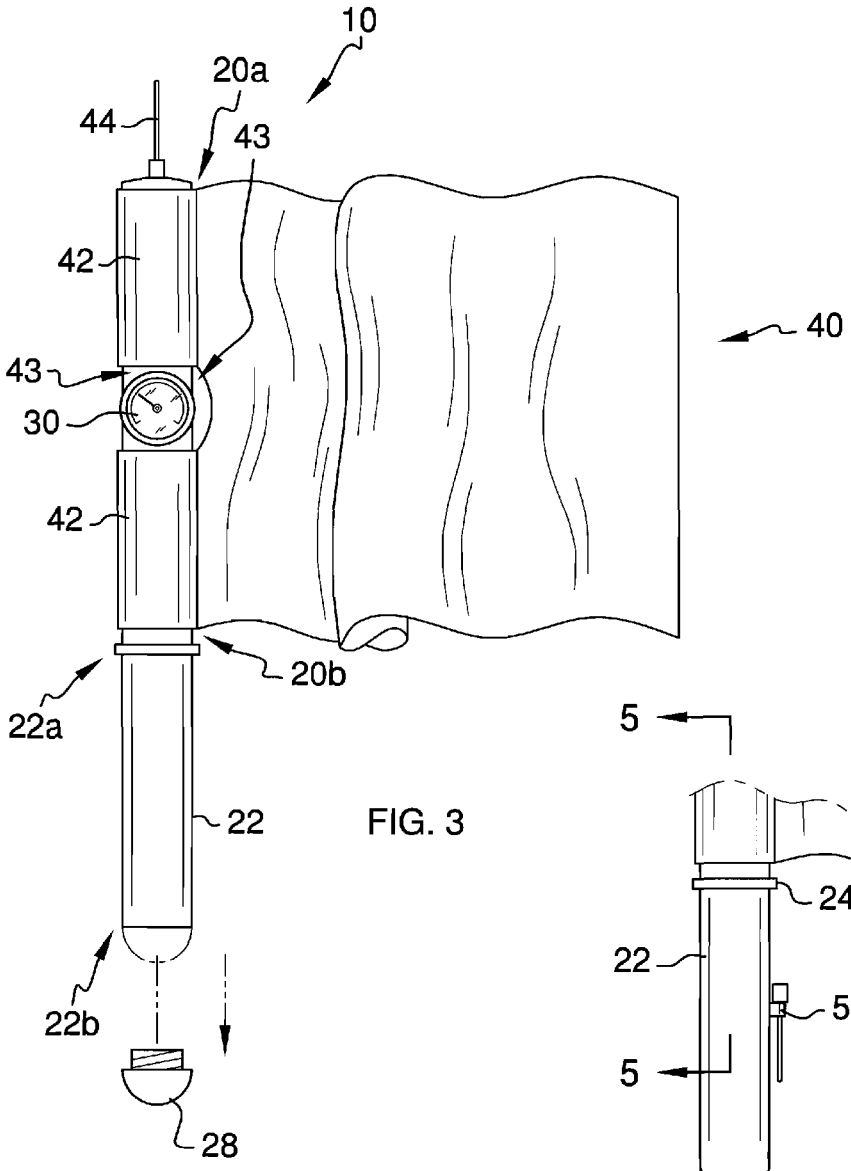
FIG. 3 is a lateral elevation view.

Referring to FIG. 3, the flag 40 is fitted exteriorly to the pump 20. The flag 40 has a banner 41 connected to the wrap 42. The wrap 42 at least partially encircles the pump 20, thereby providing optimal attachment to the pump 20 and related durability. The wrap 42 has a cutout 43 which provides visual and physical access to the air pressure gauge 30.

Referring again to FIGS. 1, and 2, the optional lidded compartment 35 is disposed within the pump 20 handle 22. The compartment 35 provides storage for additional air fittings 44 or other needed items.

Referring to FIG. 3, the optional threaded cap 28 is selectively fitted to the handle second end 22*b*.

Figure 4:
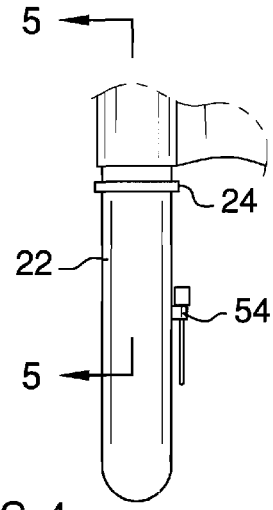
FIG. 4 is a lateral elevation view of an alternate embodiment of the pump handle.

Referring to FIG. 4, the pump handle 22 further optionally comprises an exteriorly mounted fitting clip 54. The fitting clip 54 removably secures the air fitting 44.

With respect to the above description then, it is to be realized that the optimum dimensional relationships for the parts of the officiating flag apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the officiating flag apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the officiating flag apparatus may be used.

Therefore, the foregoing is considered as illustrative only of the principles of the officiating flag apparatus. Further, since numerous modifications and changes will readily occur to those skilled in the art, it is not desired to limit the officiating flag apparatus to the exact construction and operation shown and described, and accordingly, all suitable modifications and equivalents may be resorted to, falling within the scope of the officiating flag apparatus.

What is claimed is:

1. An officiating flag apparatus, comprising, in combination:

a cylindrical air pump having a pump first end and a pump second end;

an air fitting selectively disposed within the pump first end;

a cylindrical chamber within the pump;

an air pressure gauge affixed exteriorly to the pump, the gauge in communication with the chamber;

a sealed shaft slideably disposed within a chamber orifice of the chamber, the shaft having a shaft first end and a shaft second end, the shaft first end disposed within the chamber;

a plunger disposed on the shaft first end;

a seal slideably sealing the plunger within the chamber;

a cylindrical handle having a handle first end and a handle second end, the handle first end affixed to the shaft second end;

a stop disposed on the handle first end, the stop movably abutting the pump second end;

a threaded cap selectively fitted to the handle second end;

a lidded compartment disposed within the pump handle;

a flag fitted exteriorly to the pump, the flag having a banner connected to a wrap, the wrap at least partially encircling the pump, the wrap having a cutout, the cutout providing visual and physical access to the air pressure gauge.

2. The apparatus according to claim 1 wherein the pump handle further comprises an exteriorly mounted fitting clip, the fitting clip removably securing the air fitting.

* * * * *